US006379130B1

(12) United States Patent
Shafer

(10) Patent No.: US 6,379,130 B1
(45) Date of Patent: Apr. 30, 2002

(54) MOTOR COVER RETENTION

(75) Inventor: Ronny A. Shafer, Adrian, MI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 09/591,461

(22) Filed: Jun. 9, 2000

(51) Int. Cl.[7] ..... F04B 17/03
(52) U.S. Cl. ..... 417/423.14; 417/902; 411/371.2
(58) Field of Search ..... 310/42, 89; 411/371.2; 417/410.1, 423.14, 424.1, 410.3, 410.5, 902

(56) References Cited

U.S. PATENT DOCUMENTS

| | | | | |
|---|---|---|---|---|
| 1,488,498 | A | | 4/1924 | Hoff |
| 1,967,033 | A | | 7/1934 | Lipman |
| 1,967,034 | A | | 7/1934 | Lipman |
| 2,020,258 | A | | 11/1935 | Gutjahr |
| 2,134,936 | A | | 11/1938 | Getchell et al. |
| 2,648,790 | A | | 8/1953 | Harmon |
| 2,670,447 | A | | 2/1954 | Harmon |
| 2,963,216 | A | | 12/1960 | Heitchue, Sr. |
| 3,169,696 | A | | 2/1965 | Warner |
| 3,215,343 | A | | 11/1965 | Gannaway |
| 3,299,304 | A | | 1/1967 | Hull |
| 3,428,842 | A | | 2/1969 | Harris |
| 3,465,188 | A | | 9/1969 | Sisk |
| 3,490,143 | A | | 1/1970 | Hull |
| 3,500,084 | A | | 3/1970 | Ito et al. |
| 3,894,254 | A | | 7/1975 | Holther, Jr. |
| 4,155,020 | A | | 5/1979 | Skare |
| 4,236,092 | A | | 11/1980 | DiFlora |
| 4,337,406 | A | | 6/1982 | Binder |
| 4,349,957 | A | | 9/1982 | Lundin |
| 4,396,359 | A | * | 8/1983 | Kropiwnicki ..... 417/902 |
| 4,412,791 | A | | 11/1983 | Lal |
| 4,503,347 | A | | 3/1985 | Bergman |
| 4,544,334 | A | | 10/1985 | Ellis |
| 4,593,217 | A | | 6/1986 | Levine |
| 4,606,706 | A | | 8/1986 | Utter |
| 4,734,001 | A | | 3/1988 | Bennett |
| 4,796,352 | A | | 1/1989 | Kawada et al. |
| 4,859,889 | A | | 8/1989 | Andrews et al. |
| 4,906,150 | A | | 3/1990 | Bennett |
| 4,926,081 | A | | 5/1990 | DiFlora et al. |
| 5,015,155 | A | | 5/1991 | Brown |
| 5,170,555 | A | | 12/1992 | Brown |
| 5,268,607 | A | | 12/1993 | McManus |
| 5,395,192 | A | | 3/1995 | Bennett |
| 5,487,213 | A | | 1/1996 | Hult et al. |

* cited by examiner

*Primary Examiner*—Michael Koczo
(74) *Attorney, Agent, or Firm*—Baker & Daniels

(57) ABSTRACT

A hermetic compressor including a housing, a compression mechanism disposed in the housing, a motor disposed in the housing and operatively coupled to the compression mechanism, the motor including a stator, the stator having, relative to the compression mechanism, a proximal end and a distal end, at least one fastener extending through the stator, the stator being fixed, relative to the compression mechanism, by the fastener, a motor cover disposed over the distal end of the fixed stator, a portion of the fastener extending through the cover, and a clip engaging the portion of each the fastener, the cover being retained to the fixed stator by the clip. Also methods for assembling such compressors, one of which includes the steps of providing surrounding a rotor with a stator; placing fasteners longitudinally through the stator; loosely attaching the stator and a compression mechanism with the fasteners; aligning the stator relative to the rotor, whereby an air gap therebetween is set; tightening the fasteners and fixing the stator relative to the compression mechanism after the air gap is set; aligning apertures provided in a cover with the fasteners and fitting the cover over the stator and rotor such that portions of the fasteners extend through the cover apertures, whereby the fastener portions protrude through the cover; and engaging clips onto the protruding fastener portions, whereby the cover is retained in a position between the stator and the clips.

11 Claims, 3 Drawing Sheets

MOTOR COVER RETENTION

BACKGROUND OF THE INVENTION

The present invention relates to securing a motor cover or cap to the stator of an electric motor, and particularly to the electric motor of a hermetic compressor.

Hermetic compressors are provided with an electric motor which is operatively coupled to a compression mechanism, the motor and the compression mechanism both disposed within a sealed housing. Typically, the motor has a generally cylindrical rotor through which a drive shaft longitudinally centrally extends. The drive shaft rotates with the rotor and is typically provided with an eccentric portion for imparting working motion to the compression mechanism. For example, the drive shaft may be the crankshaft of a reciprocating piston compressor, and drives the pistons in cylinders to compress the refrigerant during operation of the compressor in the well-known manner.

Surroundingly disposed about the rotor is the generally annular motor stator having windings which are electrically connected to a source of power external to the compressor, as usual. An electromagnetic force created in the stator drives the rotor, and thus the compressor mechanism.

The rotor is radially supported by means of the drive shaft being supported in a bearing portion of the compressor mechanism crankcase or frame. Initially, the stator is loosely attached to the crankcase or frame by means of a pair of bolts which extend through the length of the stator, in holes provided therein. These two bolts may be located in holes on opposite radial sides of the stator.

To provide proper operation of the motor, an air gap of constant width is established between the interfacing interior radial surface of the stator and the exterior radial surface of the rotor. The radial position of the rotor, being supported by the drive shaft, is established by the journalled interface of the drive shaft and the crankcase or frame main bearing. The radial position of the loosely attached stator is adjusted relative to the crankcase or frame to establish the proper air gap. The air gap may be set by means of a jig temporarily placed between the interfacing radial surfaces of the rotor and stator. The stator is then tightly secured to the crankcase, and thus radially fixed in place relative to the rotor, by tightening the two above-mentioned bolts. The air gap having been set, the jig, if one is used, is then removed.

Once the air gap has been set, and the jig removed, a motor cover or cap is placed over the axial ends of the stator and rotor located opposite the compression mechanism. The cover has a periphery which is attached to the end of the stator, and encloses the interior of the stator within which the rotor is located. The cover may be placed immediately after setting the air gap, or the compression mechanism and motor subassembly may undergo further processing toward assembly of the hermetic compressor before the cover is installed.

The periphery of the cover is provided with a flange or an opposed pair of radially extending ears having apertures therein. These apertures are aligned with a second pair of holes which longitudinally extend through the stator. With the cover in place on the end of the stator, clearance is provided between the cover and the heads of the first pair of bolts. A second pair of bolts, usually identical to the first pair of bolts, are then inserted through the aligned cover apertures and stator holes, and are threadedly engaged in the crankcase or frame. Thus, the stator is further and finally secured to the compression mechanism by the bolts which secure the cover to the stator.

A problem associated with such previous motor cover retention arrangements is that a change in the air gap may occur after the gap has been set. Such changes may be the result of the compression mechanism and motor subassembly being bumped or jarred during assembly, causing the stator, which is secured to the crankcase or frame by only the first pair of tightened bolts, to move relative to the rotor; or the result of installation an tightening of the second pair of bolts, which retain the cover and further clamp the stator to the compression mechanism, after the jig is removed. A way of better securing the stator so that the proper air gap can be maintained throughout the assembly process, and afterwards, is desirable.

A further problem associated with such previous motor cover retention arrangements is that retaining the cover to the stator at only a pair of radially opposite locations may not adequately secure the cover. The cover would be better secured if retained at more than only two locations.

Another problem associated with such previous motor cover retention arrangements is that the second pair of bolts, which attach the cover to the stator end as well as to help secure the stator to the crankcase or frame, may not maintain proper torque after installation, and may lead to either post-assembly air gap variations or even bolts backing out of engagement with the crankcase or frame. This result may stem from there being material or material thickness differences between the stator alone, which is clamped into place by the first pair of bolts, and the stator and cover, which are clamped into place by the second pair of bolts. Further, consistent torquing of the first and second pairs of bolts may be difficult to easily achieve, for the setting of the air gap and the installation of the cover may be done at different assembly stations, by different operators, and with different tools. To better ensure bolt clamping consistency, and reduce the risk of bolts becoming loosened, it is desirable eliminate clamped material or material thickness variations between all the stator-securing bolts, and to install all of these bolts at the same assembly station, by the same operator, and with the same tool.

A motor cover retention arrangement which avoids the above-mentioned problems associated with previous arrangements is desirable, particularly in hermetic compressor applications, for once installed, the motor is then sealed inside the housing and is thereafter practically inaccessible for service or repair.

SUMMARY OF THE INVENTION

The present invention provides a motor cover retention means which is of particular use in hermetic compressors and solves the problems associated with prior motor cover retention arrangements. Through use of the present invention, the quality and reliability of hermetic compressors can be realized vis-a-vis previous compressor utilizing the above described motor cover retention means.

In accordance with the present invention, the stator is secured to the compressor crankcase or frame with a plurality, e.g., four, bolts, which may all tightened simultaneously, or at least at the same assembly station, by the same operator, with the same tool once the air gap is set and with the air gap jig in place. The bolts have a circumferential groove defined in the heads thereof, or located between the heads and a flange which abuts the end of the stator. The periphery of motor cover is provided with a flange provided with the same number of apertures as there are stator-securing bolts, e.g., four. These cover apertures are positioned such that are each aligned with the bolt heads, and are sized to be slightly greater than the bolt heads. The cover is installed onto the end of the stator, which is already firmly secured to the compression mechanism by all of the bolts, with the heads of the bolts projecting through the cover apertures; the groove provided in or adjacent to the bolt head located on the side of the cover opposite the stator. Once in place on the end of the stator, the motor cover is secured by forcing E-clips into the grooves of the bolts. The cover is thus retained onto the stator end by the clips.

The cover or the clips may be placed in an elastically deformed state through the interface therebetween, and held in this elastically deformed state after installation of the cover and clips, the elastic deformation urging the cover into tight abutting contact with the end of the stator, to better secure the cover in its installed position. The cover may further be provided, adjacent its bolt head-receiving apertures, with one or more projections which bear against the installed E-clip, the cover urged into tight abutting contact with the stator end through the resilience of the clips and/or the cover.

The present invention provides a hermetic compressor including a housing, a compression mechanism disposed in the housing, and a motor disposed in the housing and operatively coupled to the compression mechanism, the motor comprising a stator, the stator having, relative to the compression mechanism, a proximal end and a distal end. At least one fastener extends through the stator, and the stator is fixed, relative to the compression mechanism, by the fastener. A motor cover is disposed over the distal end of the fixed stator, a portion of the fastener extending through the cover, and a clip engages the portion of each fastener, the cover being retained to the fixed stator by the clip.

The present invention also provides a method of assembling a hermetic compressor which includes the steps of: providing a compression mechanism, a motor including a rotor and a substantially annular stator, a plurality of fasteners, a motor cover provided with a plurality of apertures, and a plurality of clips; surrounding the rotor with the stator; placing the fasteners longitudinally through the stator; loosely attaching the stator and the compression mechanism with the fasteners; aligning the stator relative to the rotor, whereby an air gap therebetween is set; tightening the fasteners and fixing the stator relative to the compression mechanism after the air gap is set; aligning the cover apertures with the fasteners and fitting the cover over the stator and rotor such that portions of the fasteners extend through the cover apertures, whereby the fastener portions protrude through the cover; and engaging the clips onto the protruding fastener portions, whereby the cover is retained in a position between the stator and the clips.

The present invention also provides a method of assembling a hermetic compressor which includes the steps of: providing a compression mechanism, a rotor, a stator having a plurality of holes therethrough, a plurality of bolts having heads, a motor cover having a plurality of apertures, and a plurality of clips; positioning the stator relative to the compression mechanism; placing the plurality of bolts into the stator holes; loosely attaching the stator and the compression mechanism with the bolts; radially positioning the rotor relative to the compression mechanism; radially positioning the stator relative to the rotor, whereby a desired air gap therebetween is set; after the air gap is set, tightening the plurality of bolts to securely attach the stator and the compression mechanism, whereby the radial position of the stator relative to the rotor is fixed; placing the cover over the stator and rotor and fitting the bolt heads through the cover apertures; and engaging a clip onto each bolt adjacent its head, whereby the cover is retained between the stator and the clips.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1A:
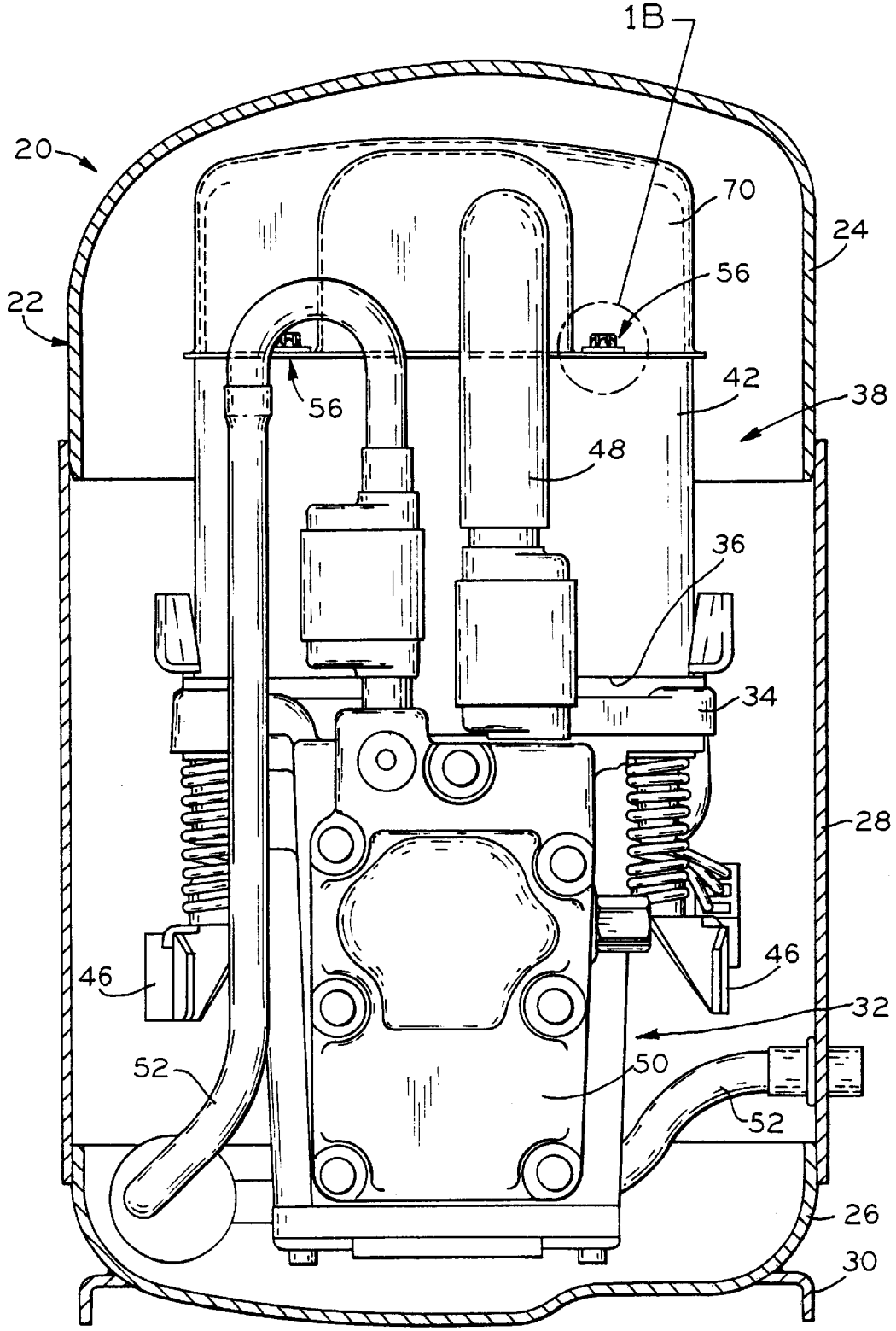
FIG. 1A is a sectional side view of one embodiment of a hermetic compressor in accordance with the present invention.

Corresponding reference characters indicate corresponding parts throughout the several views. Although the drawings represent embodiments of the present invention, the drawings are not necessarily to scale and certain features may be exaggerated in order to better illustrate and explain the present invention.

DETAILED DESCRIPTION OF THE INVENTION

In FIG. 1A, there is shown hermetic compressor 20 which includes sealed housing 22 which is comprised of upper housing portion 24, lower housing portion 26, and center housing portion 28. Housing portions 24, 26 and 28 are assembled and sealably attached to one another as by welding or brazing to provide a sealed enclosure. Lower housing portion 26 is provided with base 30 by which compressor 20 may be supported.

Disposed within housing 22 is a compression mechanism which may be of a reciprocating piston type, a rotary type, or a scroll type, each of which is well-known in the art. As depicted, compression mechanism 32 is of the reciprocating piston type. A typical reciprocating piston compression mechanism is described in U.S. Pat. No. 5,160,247 to Kandpal, issued Nov. 3, 1992, and assigned to the assignee of the present invention, the disclosure of which is expressly incorporated herein by reference.

Figure 2A:
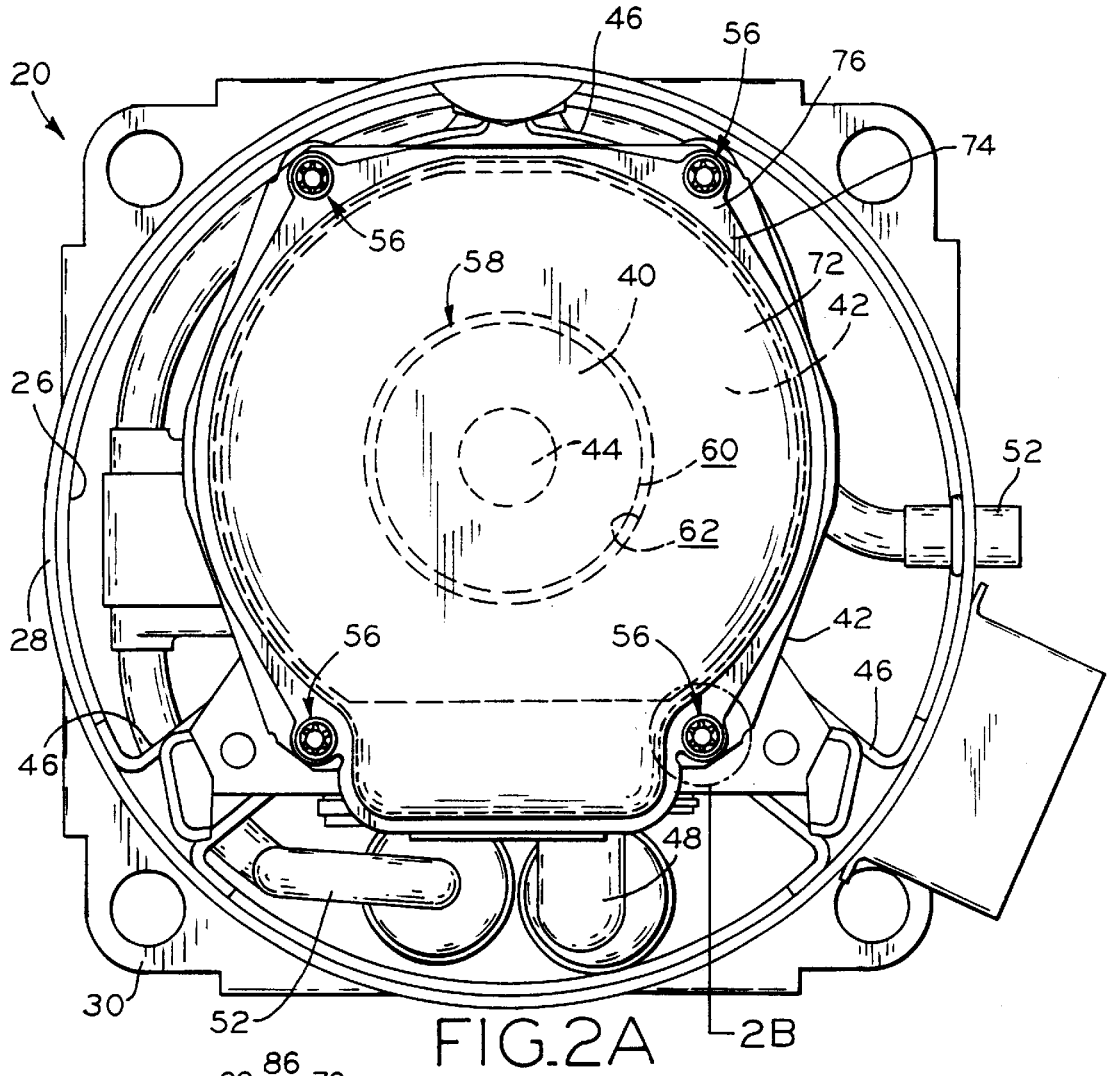
FIG. 2A is a top view of the hermetic compressor of FIG. 1A, shown with the upper housing portion removed.

Motor 38 comprises rotor 40 (FIG. 2A) and stator 42. Compression mechanism 32 includes crankcase 34 against which end 36 of stator 42 abuts. As shown in FIG. 2A, drive shaft 44 is interference fitted through the center of rotor 40 and is drivingly engaged with compression mechanism 32 to effect compression of refrigerant therein in usual way. Motor 38 and compression mechanism 32 are assembled together to form a compression mechanism/motor subassembly which is supported within housing 22 by means of a plurality of resilient mounts 46 are secured to the interior surface of center housing portion 28.

Refrigerant gas at suction pressure is introduced into the interior of housing 22 and is ingested into suction conduit 48, through which the gas is directed to the suction chamber of cylinder head 50. Through suction and exhaust valves (not shown) this gas is drawn into a cylinders (not shown), wherein it is compressed by a reciprocating piston (not shown) and then exhausted into the discharge side of cylinder head 50. The discharge side of head 50 is in sealed communication with discharge tube 52 which extends through the wall of housing 22. As usual, the compressor may be a component of a refrigeration or air conditioning system (not shown) also comprising a pair of heat exchangers and an expansion device located therebetween, all in series fluid communication via refrigerant lines.

Figure 1B:
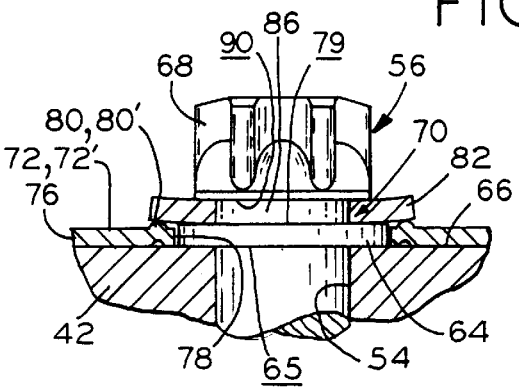
FIG. 1B is an enlarged, sectional view of encircled portion 1B of FIG. 1.
Figure 2B:
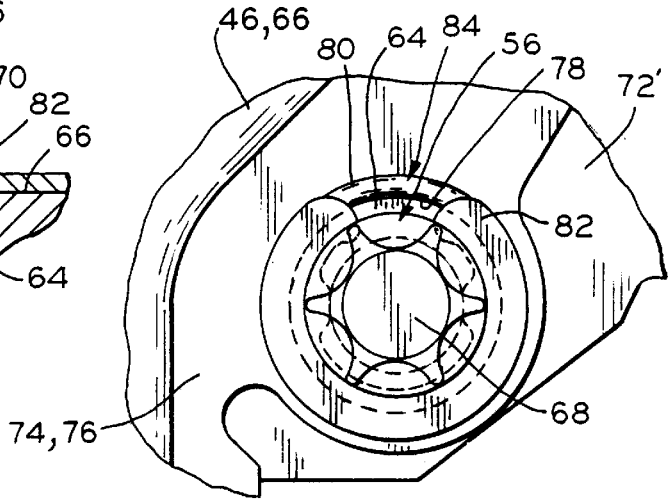
FIG. 2B is an enlarged view of encircled portion 2B of FIG. 2A.

Annular stator 42 is provided with a plurality of longitudinally extending holes 54, one of which is shown in FIG. 1B, which are aligned with mating, threaded holes provided in crankcase 34. A bolt 56 extends through each of holes 54 and secures stator 42 to compression mechanism 32. The holes which receive bolts 56 are circumferentially distributed in a substantially equal manner in the stator and crankcase, and in the motor cover, as discussed further hereinbelow.

Stator 42 is placed in surrounding relationship with rotor 40 and, initially, is loosely assembled via bolts 56 to crankcase 34. Although not shown, rotor 40 is radially positioned by means of shaft 44 being journalled in a main bearing portion of crankcase 34, in a known manner. Air gap 58 (FIG. 2A) between outer radial surface 60 of rotor 40 and inner radial surface 62 stator 42 may then be set to a consistent width in a manner described above, as through use of a jig. Once air gap 58 has been properly set, bolts 56 are tightened, tightly attaching the stator and the compression mechanism, and firmly fixing the radial position of the stator relative to the rotor. In the depicted embodiment, before any further processing, the stator is secured by all four bolts 56 once the air gap is set, rather than perhaps by only two bolts on opposite radial sides of the motor. Thus, in accordance with the present invention, once set, the air gap is comparatively better held vis-a-vis the previous, above-described compressors.

Figure 3:
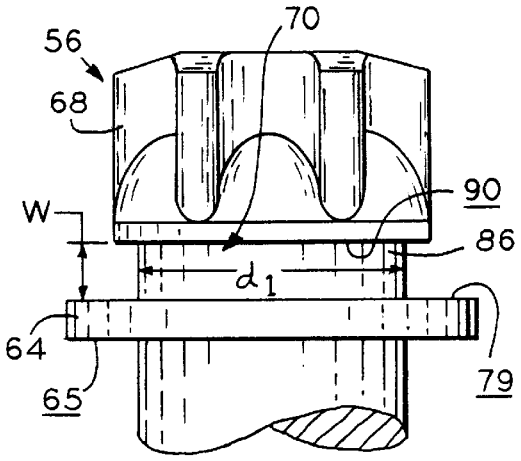
FIG. 3 is an enlarged, fragmentary side view of one embodiment of a stator-securing bolt in accordance with the present invention.

Referring to FIGS. 1B and 3, each bolt 56 is provided with annular flange 64 having annular surface 65 which abuts stator end 66 about holes 54. Bolt 56 further includes head 68 of any suitable type (e.g., hex head, star head, socket head, . . . etc . . . ) by means of which torque may be applied to bolt 56 by an appropriate tool, such as a wrench (not shown). Located between head 68 and flange 64, and formed in bolt 56, is circumferential groove 70. A suitable bolt 56 may be, for example, identified as part number 318-074-625XXX, sold by Camcar Textron of Rockford, Ill. Air gap 58 having been set and stator 42 having been securely fixed to the crankcase 34 by tightening bolts 56, a motor cover or cap is then placed over stator 42 and rotor 40. Cover 72, 72' may be a sheet metal stamping and has a periphery 74 which includes substantially planar flange 76. Flange 76 includes a plurality of apertures 78 distributed substantially equally about periphery 74; these apertures are aligned with holes 54 in stator 42 and are of diametric size to closely accommodate flange 64 of bolt 56, as shown in FIG. 1B. This figure shows that cover flange 76 has a thickness which is substantially that of bolt flange 64. The cover is easily fitted into its proper position on stator end 66 by fitting apertures 78 about flanges 64 of the tightened bolts 56. Located adjacent to and surrounding each of apertures 78 is a single, annular projection or a circumferential array of discrete projections which protrude or extend from cover flange 76 in a direction towards bolt head 68. These projections extend higher than annular surface 79 of bolt flange 64, and provide a surface, or plurality of surfaces against which a resilient retention clip may bear, as described hereinbelow.

Figure 4:
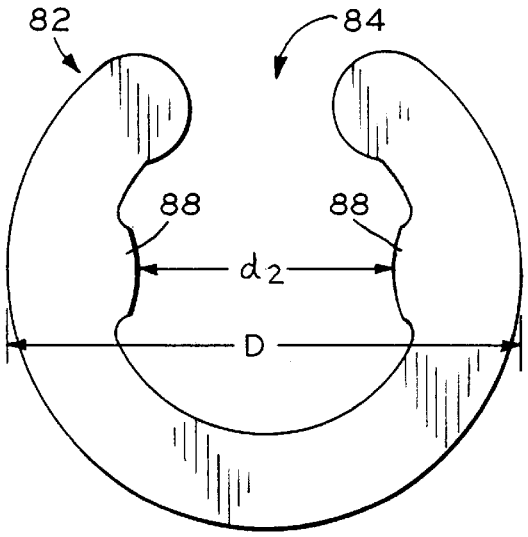
FIG. 4 is an enlarged plan view of one embodiment of a motor cover-securing clip in accordance with the present invention.
Figure 5:
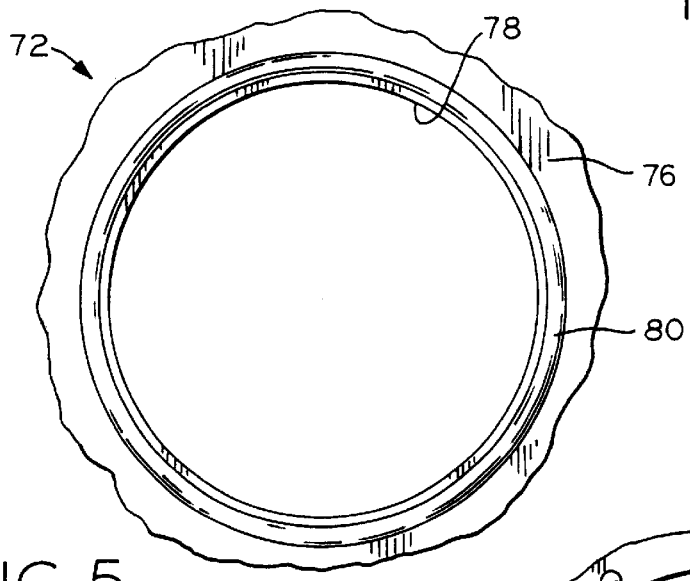
FIG. 5 is a fragmentary plan view of one embodiment of a motor cover in accordance with the present invention, showing a single projection adjacent one of the apertures therein.
Figure 6:
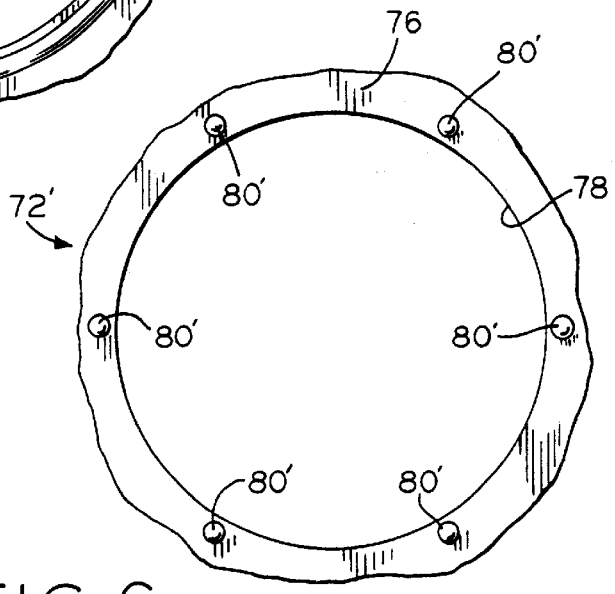
FIG. 6 is a fragmentary plan view of a second embodiment of a motor cover in accordance with the present invention, showing a plurality of projections adjacent one of the apertures therein.

Referring to FIG. 5, one embodiment of a motor cover, cover 72, includes a single annular projection 80 which surrounds aperture 78. FIG. 6 shows a portion of a second embodiment of a cover, cover 72', which is otherwise identical to cover 72 except for having, about each of its apertures 78, a plurality of discrete projections 80'. The heights of projections 80 and 80' are identical and may be, for example, 0.010 inch. FIG. 4 shows clip 82, which may be of a type commonly known in the art as an E-clip, which may be made of spring steel. A suitable clip 82 may be, for example, identified as part number 5602, sold by Imperial, Inc. of Green Bay, Wis. As shown, E-clip 82 is generally crescent shape and includes opening 84 into which groove-defining portion 86 (FIG. 3) of bolt 56 is received during clip installation. The size of opening 84 is smaller than diameter $d_1$, of bolt portion 86, and clip 82 will resiliently close circumferentially about, and be retained on, bolt portion 86 once installed in groove 70. Clip 82 has a thickness which is only slightly smaller than width W of groove 70 (FIG. 3). With reference to FIGS. 3 and 4, diameter $d_1$, of bolt portion 86 is substantially equal to distance $d_2$ between interior projections 88 inside clip 82, and clip 82 has an overall diameter D which allows clip 82, in its installed position, to cover projections 80, 80', as shown in FIG. 1B. Notably, with respect to cover 72' (FIG. 6) the plurality of discrete projections 80' about aperture 78 are of such number (e.g., six, as shown) that clip 82 may bear against all projections 80', or all but one projection 80', with clip 82 in any angular position relative to bolt 56, thereby ensuring proper retention of cover 72'.

Referring again to FIG. 1B, during installation and when in its installed position, clip 82 is elastically deformed, and is held in its elastically deformed position by its fit between annular surface 90 of bolt head 68, which defines groove 70, and projection 80 or projections 80'. Thus, it will be understood that with cover 72, 72' in its installed position, the distance between surface 90 and the tip(s) of projection(s) 80, 80' is less than the thickness of clip 82. The elastic deformation of clip 82 exerts a compressive load on cover flange 76 which urges cover 72 into abutting contact with end 66 of stator 42. With reference to FIG. 1B, projection(s) 80, 80' lie(s) radially beyond surface 90 by a distance of approximately 0.25 inch, thereby allowing clip 82 to be easily installed and still appropriately force the cover towards the stator.

Those skilled in the art will recognize that clip 82 may be installed in or removed from groove 70 by any conventional means, and appreciate that the motor cover may be designed such that the cover is more readily elastically deformed than clip 82, the elastic deformation of the cover then urging the cover into abutting contact with end 66 of stator 42.

While this invention has been described as having exemplary designs, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A hermetic compressor comprising:

a housing;

a compression mechanism disposed in said housing;

a motor disposed in said housing and operatively coupled to said compression mechanism, said motor comprising a stator, said stator having, relative to said compression mechanism, a proximal end and a distal end;

at least one fastener extending through said stator, said stator being fixed, relative to said compression mechanism, by said fastener;

a motor cover disposed over said distal end of said fixed stator, said fastener extending through said cover; and a clip engaging said portion of each said fastener, said cover being retained to said fixed stator by said clip.

2. The compressor of claim 1, wherein said at least one fastener is provided with a circumferential groove, said groove located on a side of said cover opposite said fixed stator, said clip engaging said fastener groove.

3. The compressor of claim 2, wherein one of said clip and said cover is maintained in an elastically deformed state, whereby said cover is urged into abutting engagement with said stator end.

4. The compressor of claim 1, wherein said clip at least partially surrounds said fastener.

5. The compressor of claim 4, wherein said clip is an E-clip.

6. The compressor of claim 1, wherein said fastener is a bolt having a head, said groove located adjacent said head.

7. The compressor of claim 1, wherein said cover has a periphery provided with an aperture through which said fastener extends.

8. The compressor of claim 7, wherein said cover is provided with at least one projection adjacent said cover aperture, said clip in abutting contact with said projection.

9. The compressor of claim 7, wherein said at least one fastener is a plurality of fasteners, and said cover periphery is provided with a plurality of said apertures aligned with said fasteners and through which said fasteners extend.

10. The compressor of claim 9, wherein said fasteners are substantially equally distributed about said cover periphery.

11. The compressor of claim 1, wherein said cover is a metal stamping.

* * * * *